US008419168B2

(12) United States Patent
Okano et al.

(10) Patent No.: US 8,419,168 B2
(45) Date of Patent: Apr. 16, 2013

(54) LIQUID EJECTION HEAD AND MANUFACTURING METHOD THEREFOR

(75) Inventors: Akihiko Okano, Fujisawa (JP); Masahiko Kubota, Tokyo (JP); Ryoji Kanri, Zushi (JP); Yoshiyuki Fukumoto, Kawasaki (JP); Masafumi Morisue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/218,851

(22) Filed: Aug. 26, 2011

(65) Prior Publication Data

US 2012/0069094 A1 Mar. 22, 2012

(30) Foreign Application Priority Data

Sep. 21, 2010 (JP) ..... 2010-211139

(51) Int. Cl.
*B41J 2/04* (2006.01)

(52) U.S. Cl. ..... 347/54

(58) Field of Classification Search ..... 347/20, 347/54, 56, 60, 61
See application file for complete search history.

(56) References Cited

U.S. PATENT DOCUMENTS

| | | | |
|---|---|---|---|
| 6,555,480 | B2 | 4/2003 | Milligan et al. |
| 7,380,915 | B2 | 6/2008 | Terui |
| 7,985,531 | B2 | 7/2011 | Kanri et al. |
| 2006/0277755 | A1 | 12/2006 | Kubota et al. |

FOREIGN PATENT DOCUMENTS

| | | | |
|---|---|---|---|
| JP | 2003-053979 | A | 2/2003 |
| JP | 2006-130868 | A | 5/2006 |

*Primary Examiner* — An Do
(74) *Attorney, Agent, or Firm* — Fitzpatrick, Cella, Harper & Scinto

(57) ABSTRACT

Provided is a liquid ejection head including a substrate including a liquid supply port and an energy generating element, in which the liquid supply port has at least one groove shape formed in a wall surface thereof, the at least one groove shape extending from a rear surface, which is a surface opposite to a front surface on which the energy generating element is formed, toward the front surface.

9 Claims, 6 Drawing Sheets

LIQUID EJECTION HEAD AND MANUFACTURING METHOD THEREFOR

BACKGROUND OF THE INVENTION

1. Field of the Invention

The present invention relates to a liquid ejection head for ejecting liquid and a manufacturing method therefor.

2. Description of the Related Art

As a method of forming ink supply ports in an ink jet recording head, as described in Japanese Patent Application Laid-Open No. 2006-130868, there is a method of forming the ink supply ports by using dry etching from a rear surface of a substrate. In a case of a product such as the ink jet recording head, in which many ink supply ports are formed in a wafer, by using dry etching to form the ink supply ports, it is possible to suppress increase in opening width of the ink supply ports.

In order to form the ink supply port in the substrate to have a shape perpendicular to a surface direction, as described in Japanese Patent Application Laid-Open No. 2003-053979, a Bosch™ process is generally used, which performs coating and etching alternately. For example, by deep reactive ion etching (DRIE) using the Bosch process, a deep ink supply port having the perpendicular shape can be formed. As for the summary of the Bosch process, the following three processes, that is, (1) a process of forming a coating film by a fluorine-based material, (2) a process of removing the coating film at a bottom surface, and (3) a process of etching the substrate are mainly repeated, to thereby form a highly perpendicular shape in the substrate. More details are described below. (1) A $(CF_2)_n$-based coating film is formed on the surface by, as the fluorine-based material, a fluorocarbon gas. With this coating film, etching of a side wall is prevented in the subsequent etching process. (2) The etching gas and the fluorine-based material are replaced, and generated ions are caused to move to an engraved bottom surface. The coating film at the bottom surface is broken by the ions. (3) As an etchant, a reactive etching gas creates fluorine radicals and charged particles from $SF_6$, and forms volatile $SiF_X$. Those radicals etch the substrate chemically or physically, to thereby remove the substrate material.

In the Bosch process, the above-mentioned three processes are repeated. Therefore, on the side wall of the ink supply port, a ring-like repeating shape constituted by groove portions and protruding portions is formed in a depth direction of the ink supply port (see FIG. 2). Further, in a case where the process (3) has fast etching rate, the engraved amount of the groove portion becomes large, and hence the width of the ring-like repeating shape tends to increase. Hereinafter, the ring-like repeating shape constituted by the groove portions and the protruding portions is also referred to as a scallop pattern.

Generally, in order to ensure the shape formed by dry etching in the substrate surface, a stop layer having high selectivity is disposed at an etching terminal portion. The stop layer is removed by removal liquid or removal gas after the dry etching is completed. In the ink jet recording head, a flow path forming member is formed on a front surface side of the substrate, and hence, in some cases, it is difficult to remove the stop layer from the front surface side. Further, in order to use the removal gas, an apparatus for generating a large amount of fluorine-based gas is necessary. This apparatus is difficult to handle and dangerous in some cases. Therefore, it is desired that the stop layer be removed by causing the removal liquid to flow in from the ink supply port formed by dry etching from a rear surface side.

However, in the ink supply port formed by dry etching using the Bosch process, the ring-shaped scallop pattern is continuously formed in the depth direction, and hence when the removal liquid is supplied in the ink supply port, a liquid film is likely to be formed at the protruding portions of the scallop pattern. When a liquid film (hereinafter, referred to as a meniscus) is formed at the protruding portions of the scallop pattern, substitution of liquid and gas cannot be easily progressed, and in some of the supply ports, the removal liquid cannot reach the stop layer. Therefore, in some cases, fluctuations in removal of the stop layer occur. The fluctuations in removal of the stop layer lead to reduction in reliability.

Further, when the dry etching is performed in a higher rate, the engraved amount of the groove portion increases. In this case, the meniscus is more likely to be formed at the protruding portions. Further, as the size of the opening of the ink supply port becomes smaller, the meniscus is more likely to be formed. Further, as liquid having higher surface tension is used, the meniscus is more likely to be formed. As described above, there is a case where a usable range may be limited in terms of design and materials.

SUMMARY OF THE INVENTION

Therefore, it is an object of the present invention to provide a manufacturing method of a liquid ejection head which includes a liquid supply port into which liquid can be caused to flow satisfactorily.

The present invention provides a liquid ejection head, including a substrate including: a liquid supply port for supplying liquid to a liquid flow path which is provided in communication with an ejection orifice for ejecting the liquid; and an energy generating element for generating energy used for ejecting the liquid from the ejection orifice, in which the liquid supply port has at least one groove shape formed in a wall surface thereof, the at least one groove shape extending from a rear surface, which is a surface opposite to a front surface on which the energy generating element is formed, toward the front surface.

Further, the present invention provides a manufacturing method of a liquid ejection head including a substrate including: a liquid supply port for supplying liquid to a liquid flow path which is provided in communication with an ejection orifice for ejecting the liquid; and an energy generating element for generating energy used for ejecting the liquid from the ejection orifice, the manufacturing method including: a step (1) of forming an etch resistant mask having an opening corresponding to the liquid supply port on a rear surface of the substrate having the energy generating element formed on a front surface side; and a step (2) of forming the liquid supply port by dry etching processing of the substrate with use of the etch resistant mask, in which, in the step (1), a region around the opening of the etch resistant mask becomes thinner toward the opening.

Further features of the present invention will become apparent from the following description of exemplary embodiments with reference to the attached drawings.

BRIEF DESCRIPTION OF THE DRAWINGS

FIGS. 4A and 4B are schematic cross-sectional views illustrating the liquid supply port in which a groove shape is formed in a side surface by dry etching using the Bosch process while retracting the etch resistant mask, of which FIG. 4A is a schematic plan view as viewed from above an etching start surface, and FIG. 4B is a schematic cross-sectional view taken along the line 4B-4B of FIG. 4A.

DESCRIPTION OF THE EMBODIMENTS

Figure 1A:
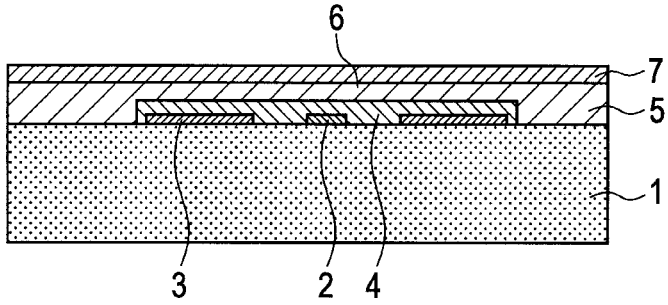
FIGS. 1A, 1B, 1C, 1D, and 1E are cross-sectional views schematically illustrating steps of a manufacturing method of an ink jet recording head according to an embodiment of the present invention.
Figure 1B:
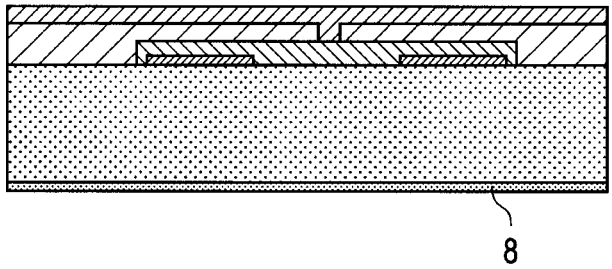

A manufacturing method of a liquid ejection head according to the present invention is described below in detail by means of an embodiment with reference to the drawings. Further, in the following description, an ink jet recording head is exemplified as an application example of the present invention in some cases, but the application range of the present invention is not limited thereto. For example, the present invention may also be applied in, other than ink recording, biochip manufacturing or electronic circuit printing. That is, the present invention relates to a liquid ejection head for ejecting liquid. Examples of the liquid ejection head may include, other than the ink jet recording head, a head for color filter manufacturing.

FIGS. 1A to 1E are views illustrating manufacturing steps of an ink jet recording head.

First, a substrate 1 having energy generating elements 2 formed on a front surface side is prepared.

The substrate includes the energy generating element 2 for causing ejection of liquid such as ink. Examples of the material of the substrate include silicon, glass, ceramics, and metal. Examples of the energy generating element include, but are not limited to, a thermoelectric generating element or a piezoelectric element. When the thermoelectric generating element is used as the energy generating element, a protective film (not shown) may be formed for the purposes of relaxation of impact when bubbles are generated, reduction in damage to be caused by the ink, and the like.

Further, the substrate 1 used is preferred to have stop layers 3 formed on the front surface thereof. The stop layer 3 functions as a stop layer in dry etching processing performed in a subsequent step. As the stop layer 3, for example, an insulating layer made of TEOS, SiN, or SiC may be used. Further, as the stop layer 3, for example, a laminate film functioning as, for example, wiring made of TaAl, Al, and the like, or a heater member may be used. Those materials are preferred because those materials lower the etching rate in the dry etching. Note that, the material of the stop layer is not limited to those materials as long as the stop layer exerts a function to stop the etching.

Next, on the front surface of the substrate 1, a flow path mold member 4 as a mold of an ink flow path is formed.

The flow path mold member 4 may be formed employing, for example, a mold injection method using a photosensitive resin. More specifically, a positive photosensitive resin may be used to form the flow path mold member 4 as a mold of the ink flow path.

Next, a flow path forming member 5 is formed so as to cover the flow path mold member 4.

The flow path forming member 5 may be formed of, for example, a negative photosensitive resin.

Next, an ejection orifice 6 is formed in the flow path forming member 5.

The ejection orifice 6 may be formed by, for example, performing exposure to the flow path forming member with the use of a mask having a pattern of the ejection orifice, and then performing development.

Next, the flow path forming member 5 is covered with a protective film 7.

As the protective film 7, a member may be used, which protects the flow path forming member from the etching process performed in a subsequent step and which does not inhibit the functions of the flow path forming member and the flow path mold member. As the protective film 7, for example, OBC (trade name) manufactured by TOKYO OHKA KOGYO CO., LTD. may be used.

FIG. 1A illustrates a conceptual view of the above-mentioned steps.

Next, on a rear surface of the substrate 1, an etch resistant film 8 is formed. As the etch resistant film, a material may be used, which functions as a mask for the dry etching performed in a subsequent step.

Examples of the material forming the etch resistant film include, in view of excellent resistance with respect to a dry etching gas used when the ink supply port is formed in a subsequent step and excellent adhesiveness, a novolak resin derivative and a naphthoquinone diazide derivative. Further, the thickness of the etch resistant film is not particularly limited, and the etch resistant film may be used without a problem even if the thickness thereof is several micrometers as long as the film functions as an etch resistant film. Further, as a preferred etch resistant film, AZ-P4620 (trade name, manufactured by AZ Electronic Materials Ltd.) may be used. The rear surface of the substrate may be coated with this etch resistant film using a coating method such as spin coating, slit coating, or spray coating. Further, as necessary, the substrate may be subjected to pretreatment before the etch resistant film is formed, to thereby improve the adhesiveness with the etch resistant film.

Figure 1C:
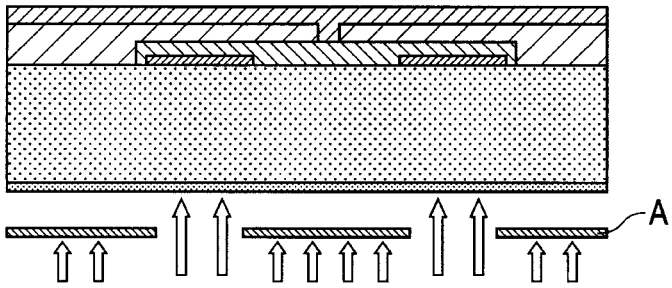
Figure 1D:
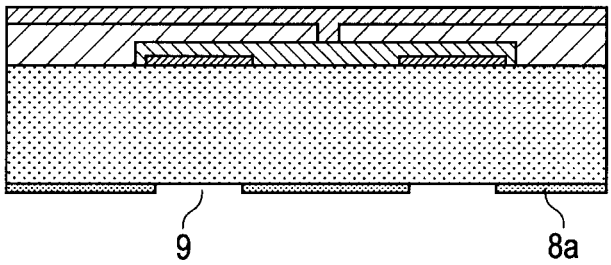

Next, as illustrated in FIGS. 1C and 1D, openings 9 for the ink supply ports are formed in the etch resistant film 8, to thereby form an etch resistant mask 8*a*.

As a method of forming the openings 9 corresponding to the ink supply ports in the etch resistant film 8, a photolithography technology performing the exposure processing and the development processing may be used. For example, the exposure to the etch resistant film 8 may be performed by, for example, proximity exposure, mirror projection exposure, or stepper exposure, with the use of a photomask A (see FIG. 1C) having a pattern corresponding to the openings for the ink supply ports. Further, the development processing of the pattern may be performed through immersion in a developer by a dipping method, a puddling method, or a spraying method. Further, in order to improve the etching resistance performance after the opening pattern for the ink supply ports is formed, it is also effective to perform post baking processing.

Next, the region around the opening 9 of the etch resistant mask 8*a* is processed into a shape that becomes thinner toward the opening 9. As the shape that becomes thinner toward the opening 9, there may be exemplified a shape in which the thickness becomes thinner toward the opening 9 from a distance in a radial direction with the opening 9 as the center. Alternatively, there may be exemplified a shape in which the thickness becomes thinner with a certain curvature, or a shape in which only the edge portion in the vicinity of the opening 9 is rounded. Further, the tendency that the film becomes thinner around the opening 9 is not required to be uniform.

Such a shape can be formed by, after the opening is formed, heating at least around the opening, to thereby round the edge portion. More specifically, after the opening pattern is formed, heating is performed to a temperature equal to or higher than a glass transition point of the etch resistant mask or a temperature which makes the fluidity high to cause natural flow to start, and a sufficient time period is taken to cause the flow. With this, the edge portion of the opening can be rounded due to the surface tension of the etch resistant material. Further, when the wettability of the substrate surface on which the etch resistant mask is formed is high, the heating may cause the shape to be spread toward the bottom, and this spread shape is suitable for the present invention.

Further, the method of forming the region around the opening of the etch resistant mask so as to become thinner toward the opening is not limited to the above-mentioned method. For example, a method is also possible, in which focus is slightly shifted during the exposure when the opening pattern is to be formed to perform exposure in a defocused manner, to thereby reduce the thickness of the etch resistant mask at a portion in the vicinity of the edge portion of the opening after the development. Note that, the method is not limited to those methods as long as a method is employed, in which the etch resistant mask is formed so that the periphery of the opening becomes thinner toward the opening.

Figure 1E:
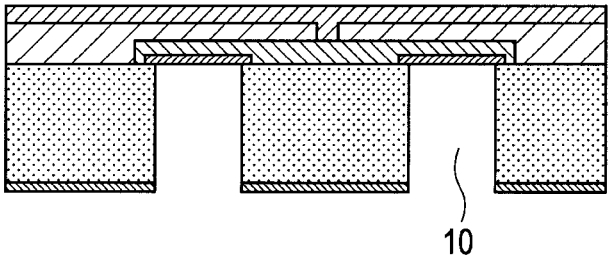
Figure 3:
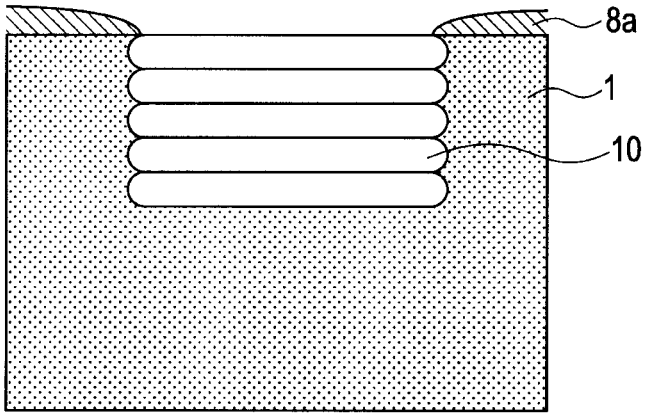
FIG. 3 is a schematic cross-sectional view illustrating a step of forming the liquid supply port by the Bosch process, with the use of an etch resistant mask having a shape in which the thickness of the mask around an opening becomes thinner toward the opening.

Next, with the use of the etch resistant mask 8*a* having the above-mentioned shape, the dry etching processing is performed from the rear surface of the substrate, to thereby form ink supply ports 10 (see FIG. 1E). Note that, FIG. 3 illustrates a state of the etch resistant mask having a shape in which the region around the opening becomes thinner toward the opening.

By performing dry etching with the use of the etch resistant mask 8*a* having a shape in which the thickness of the mask around the opening becomes thinner toward the opening as described above, a groove shape may be formed in the wall surface of the ink supply port. During dry etching, the thickness of the etch resistant mask is reduced more than a little by the dry etching, and in particular, at the edge portion of the opening having a thin thickness, the substrate is exposed earlier. That is, the substrate is gradually exposed so as to be in such a state that the etch resistant mask is retracted from the edge portion of the opening. A part of the etch resistant mask is thus removed, and the exposed portion of the substrate is subjected to etching. However, due to the film thickness unevenness of the etching mask layer or etching unevenness, the etch resistant mask is not uniformly retracted, and when the opening is viewed from the side from which liquid is ejected (upper side of FIGS. 1A to 1E), there occurs a state in which dappled island-shaped residues (remaining etching mask forms islands) are generated. The film thickness unevenness may be formed by a general spin coating method in some cases. Further, by employing the spray coating method, it is possible to form an appropriate unevenness by the surface unevenness or by causing the solidified particles generated during spraying to accumulate, but the method is not limited thereto as long as the method enables formation of a similar shape. In this manner, the residues function as a mask, and a portion where the residues are absent is subjected to etching, to thereby form the groove shape in the wall surface of the ink supply port.

In this method, the etch resistant mask starts to retract ununiformly from the edge portion of the opening in the middle of the dry etching processing, and hence the groove shape is formed from the surface of the opening in the depth direction. The groove shape may be formed of an aggregate of columnar grooves formed by using the residues as a mask or a jagged groove formed in such a state of being engraved from the upper side of the etching start surface, or a combination thereof.

As the dry etching, dry etching using a Bosch process is preferred. Further, as the dry etching, dry etching such as ECR, ICP, or RIE may be employed. Further, in order to form the ink supply port having a perpendicular depth of 50 μm or more, it is preferred to use an ICP etcher which is capable of performing a Bosch process which repeats etching and deposition.

The dry etching is performed to reach the stop layer 3. By disposing the stop layer, the ink supply ports may be formed in uniform depths within the wafer. The stop layer may be removed by removal liquid after the etching is completed. Further, the dry etching may be performed until the groove shape is formed to have an arbitrary length, and the dry etching is preferred to be performed so that the groove shape is formed up to the middle of the substrate.

In the present invention, the groove shape formed in the wall surface of the ink supply port functions to guide liquid into the opening, and thus liquid such as removal liquid can be easily caused to flow into the supply port.

The present invention is particularly effective in a case where the ink supply port is formed by dry etching using the Bosch process.

Figure 2:
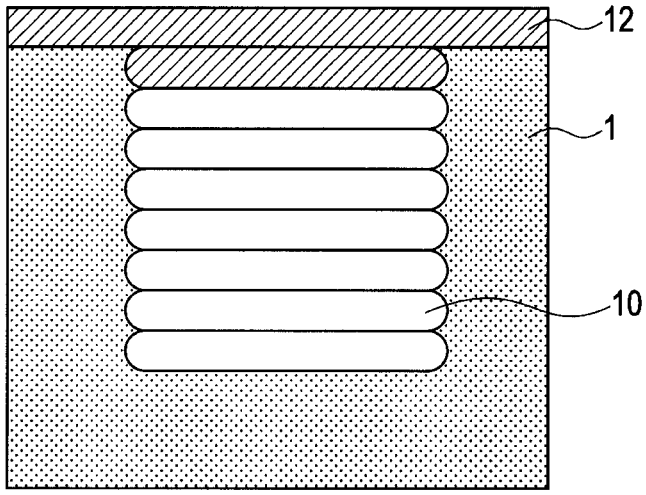
FIG. 2 is a schematic cross-sectional view of a liquid supply port which is formed up to the middle of a substrate by dry etching using a Bosch process.
Figure 4A:
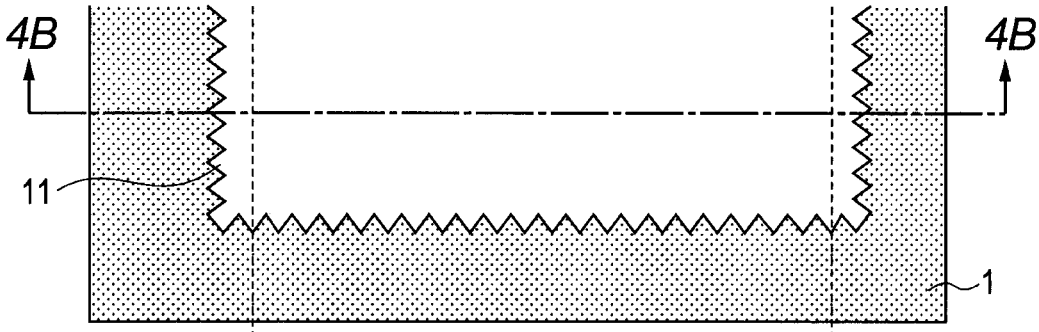
Figure 4B:
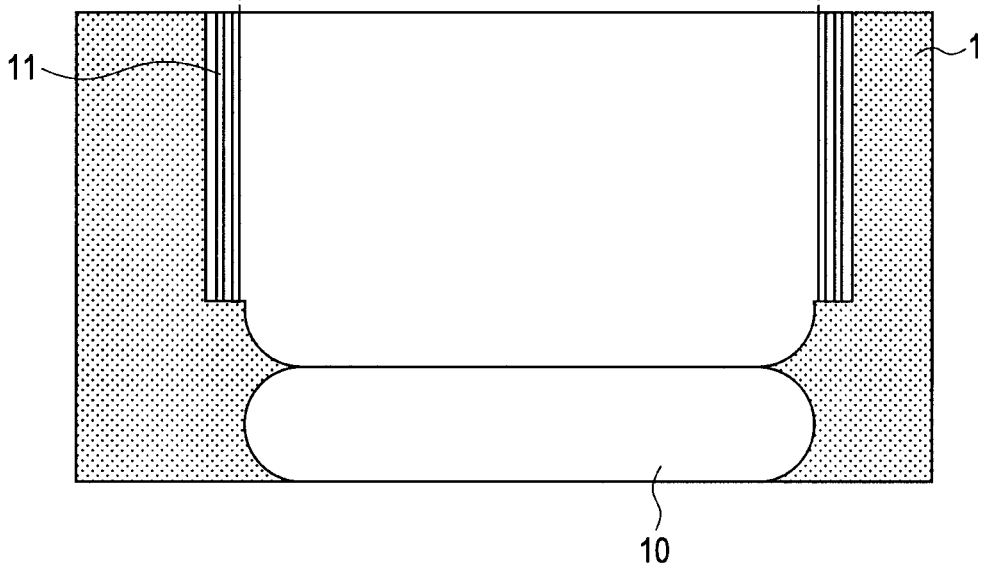

As described above, when the ink supply port is formed by dry etching using the Bosch process, as illustrated in FIG. 2, a scallop pattern is formed in the side wall of the ink supply port. In the ink supply port in which the scallop pattern is formed, a meniscus is formed at the protruding portions of the scallop pattern, and in some cases, there occurs a phenomenon that substitution of liquid and gas is not easily progressed in the ink supply port. This is because the scallop pattern has a ring-like repeating shape of the depth of several micrometers, and when the meniscus is stuck on the protrusions of the scallop pattern, the force of the liquid falling down from the above is dispersed by the meniscus formed in a dome shape and is stabilized. This phenomenon occurs more notably as the size of the ink supply port is smaller. Further, this phenomenon occurs more notably as the surface tension of the used liquid such as removal liquid is larger. For example, the phenomenon is likely to occur when the size in the vertical and lateral directions of the ink supply port is several ten micrometers to several hundred micrometers. In consideration of above, by forming the groove shape in the side wall of the ink supply port, substitution of liquid and gas can be stably performed in a short period of time. In other words, as illustrated in FIGS. 4A and 4B, by forming a groove shape 11 in the side wall from the opening surface when the ink supply port is formed, the liquid is guided to the groove. In this manner, the substitution of liquid and gas can be smoothly performed.

Figure 5:
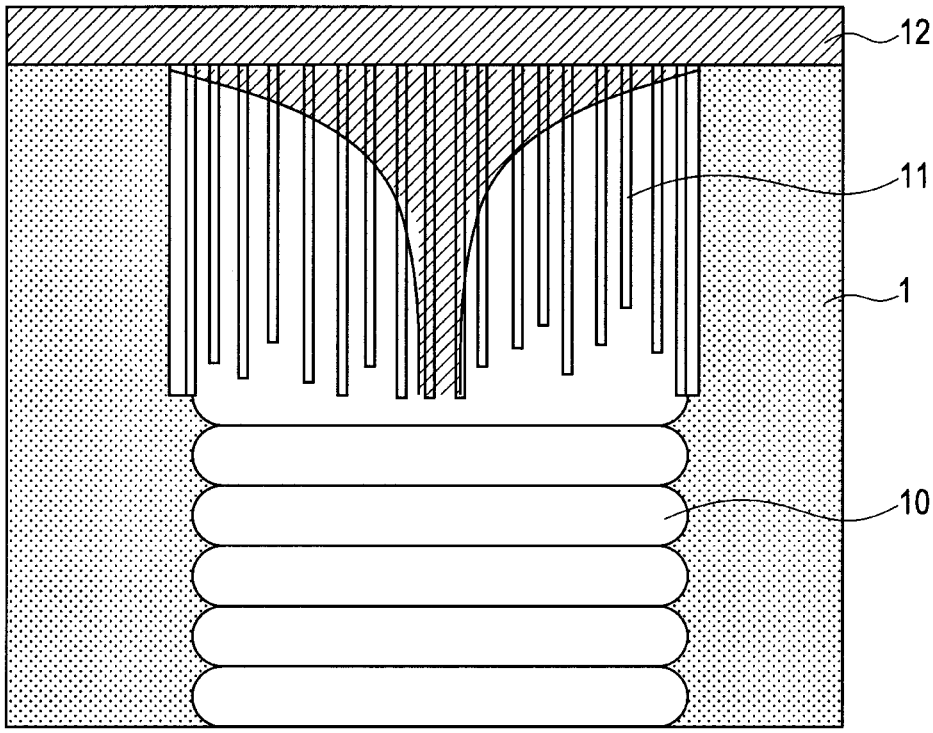
FIG. 5 is a schematic cross-sectional view illustrating a situation in which removal liquid for a stop layer is caused to flow into the liquid supply port having the groove shape.

Specifically, because the groove shape 11 is formed in the wall surface, the liquid starts to flow along the groove without forming the meniscus, which makes it possible to cause the liquid to flow into the ink supply port along the wall surface. Further, more specifically, the liquid starts to flow from a portion having a wide width of the groove shape 11 formed in the wall surface, and the liquid concentrates in that direction, which causes the liquid to flow in easier (see FIG. 5).

After the ink supply port having the groove shape in the side surface thereof is formed, the etch resistant mask 8*a* is removed. Further, the protective film 7 on the front surface is removed, to thereby remove the flow path mold member. Thus, the ink flow path is formed.

With the method described above, the ink jet recording head can be manufactured.

Further, the present invention is suitable because, by forming the groove shape to have grooves with various large and small widths, the liquid is caused to flow into the ink supply port from the groove having a wide width without forming the meniscus. Further, in order to break the meniscus, it is required that the liquid flow into the ink supply port to a certain level of depth, and hence the depth of the groove shape is desired to be formed toward the terminal portion of the opening with a depth equal to or larger than a certain level.

Actually, the groove shape is desired to be formed of an aggregate of grooves having a width of several micrometers to several ten micrometers.

The length of the groove shape is preferred to be equal to or larger than 30 μm from the opening surface of the liquid supply port. After a certain amount of liquid flows in, the liquid gains force, and the liquid which flows in even without the groove shape starts to flow into the supply port over the protrusion of the scallop pattern. Therefore, if the groove shape is formed in a length which can cause liquid flow to some extent, the groove shape can sufficiently exert its effect. Further, the terminal portion of the liquid supply port is communicated to the liquid flow path such as the ink flow path. In order to stabilize the flow path resistance to the ejection orifice, it is preferred not to form the groove shape in the vicinity of the terminal portion. Therefore, in the present invention, the groove shape is formed only in the vicinity of the opening surface, and is preferred to be formed in a range of 30 μm or more and 100 μm or less from the opening surface.

Figure 6:
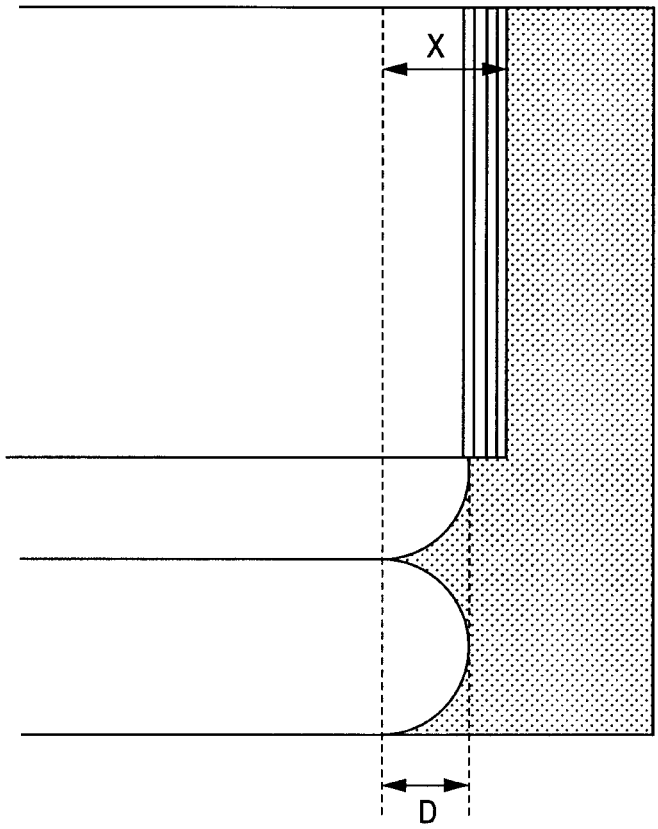
FIG. 6 is a schematic cross-sectional view illustrating a dimension relationship of the groove shape.

Further, as in a cross section of FIG. 6, a distance from a leading end of the protruding portion of the scallop pattern to an engraved portion of the scallop pattern is set as an engraved depth D of the scallop pattern. Further, as in the cross section of FIG. 6, a distance from the leading end of the protruding portion of the scallop pattern to an engraved portion of the groove shape is set as an engraved depth X of the groove shape. When defined as above, in order to form a shape that eliminates the influence caused by the scallop pattern, X is preferred to be larger than D.

Further, in order to perform sufficient substitution of liquid and gas, it is effective to perform pretreatment on the wall surface of the ink supply port to be hydrophilic or lipophilic, depending on the liquid flowing therein. Further, it is also effective to cause the entire substrate to vibrate by ultrasonic waves, to thereby cause the liquid to flow in easier.

A liquid ejection head according to the present invention is described below in detail by means of an embodiment with reference to the drawings. Further, in the following description, an ink jet recording head is exemplified in some cases as an application example of the present invention, but the application range of the present invention is not limited thereto. For example, the present invention may also be applied in, other than ink recording, biochip manufacturing or electronic circuit printing. That is, the present invention relates to a liquid ejection head for ejecting liquid. Examples of the liquid ejection head may include, other than the ink jet recording head, a head for color filter manufacturing.

Figure 8:
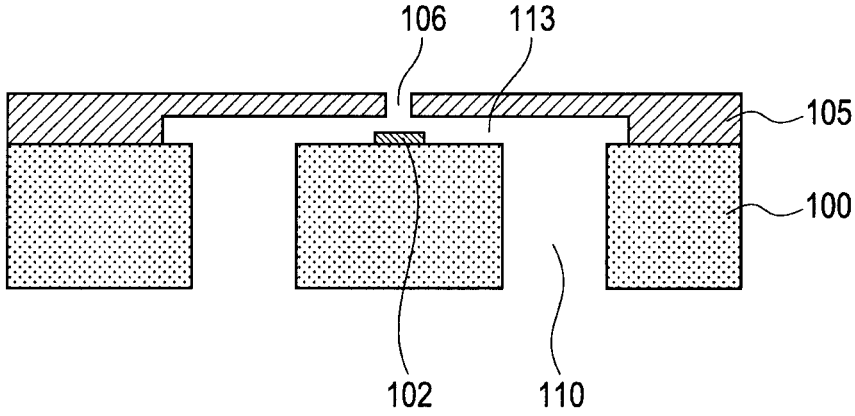
FIG. 8 is a schematic cross-sectional view illustrating a structural example of a liquid ejection head according to the present invention.

FIG. 8 is a schematic cross-sectional view illustrating a structural example of the ink jet recording head according to the embodiment of the present invention.

As illustrated in FIG. 8, the ink jet recording head includes a substrate 100 having a flow path forming member 105 formed on its upper surface. On a surface (rear surface) of the substrate 1 opposite to a surface on which the flow path forming member 105 is disposed, a support member (not shown) may be disposed. The flow path forming member 105 is constituted by an ink flow path (liquid flow path) 113 and an ink ejection orifice (ejection orifice) 106. The substrate 100 includes multiple ejection energy generating elements 102, such as thermoelectric conversion elements, for causing ejection of ink (liquid), and may also include wiring (not shown) for driving the ejection energy generating elements, and the like. Further, the substrate 100 includes an ink supply port (liquid supply port) 110 for supplying ink to the ink flow path 113. Multiple ink supply ports 110 are formed so as to pass through the substrate 100.

In the liquid supply port of the present invention, at least one groove shape is formed in a wall surface, the at least one groove shape extending from a rear surface, which is a surface opposite to a front surface on which the energy generating elements are formed, toward the front surface. That is, in the wall surface of the liquid supply port, the groove shape is formed from the opening surface toward the front surface of the substrate. Further, it is preferred that the supply port be formed perpendicularly to a surface direction of the substrate, and the groove shape also be formed in a direction substantially perpendicular to the surface direction.

In the liquid ejection head according to the present invention, the liquid supply port includes the groove shape in the wall surface thereof, and hence the removal liquid for the stop layer and the like can be caused to flow into the liquid supply port sufficiently, and the stop layer can be efficiently removed in good yield during the manufacturing of the liquid ejection head. Further, the liquid supply port is formed to include the groove shape, and hence it is possible to stably supply liquid such as ink to the liquid supply port, which makes it possible to obtain a liquid ejection head with no remaining bubbles and high reliability.

The groove shape is formed of an aggregate of grooves formed by using the residues as a mask or a jagged groove formed in such a state of being engraved from the upper side of the etching start surface, or a combination thereof. This is suitable because, by forming the groove shape to have grooves with various large and small widths, the liquid flows into the ink supply port from the groove having a wide width without forming the meniscus. Further, in order to break the meniscus, the liquid is required to flow into the opening to a certain level of depth, and hence the depth of the groove shape is desired to be formed toward the terminal portion of the opening with a depth equal to or larger than a certain level. The depth is preferred to be 30 μm or more from the opening surface of the liquid supply port. As a formation method of the groove shape, as described above, the residues of the etch resistant mask are used, to thereby form the groove shape in the wall surface of the ink supply port.

The substrate may be constituted by using, for example, a silicon substrate.

The liquid supply port can be formed by, for example, anisotropic etching. As the anisotropic etching, it is preferred to employ dry etching such as reactive ion etching (RIE). Further, the liquid supply port is preferred to be formed by the Bosch process using the RIE.

Examples of the material of the flow path forming member include a photosensitive epoxy resin and a photosensitive acrylic resin, and it is preferred to use a photoinitiated cationic polymerization compound. Further, appropriate compounds may be selected as the material of the flow path forming member depending on the used liquid such as ink, because durability of the flow path forming member is greatly influenced depending on the type and characteristics of the used liquid.

The substrate may include a wiring layer for transmitting an electrical signal, and, for example, Al wiring may be formed by a film forming technology.

Further, the ink jet recording head as the embodiment of the present invention is mountable to an apparatus such as a printer, a copier, a fax machine including a communication system, and a word processor including a printer portion, or an industrial recording apparatus in which various processing apparatuses are combined in a composite manner. Further, with the use of this ink jet recording head, recording on various recording media can be performed, such as paper, thread, fiber, cloth, leather, metal, plastic, glass, wood, and ceramics.

EXAMPLE 1

In this example, with the manufacturing method of an ink jet recording head illustrated in FIGS. 1A to 1E, the ink jet recording head was manufactured.

First, as the substrate 1, a silicon substrate was prepared, on which the energy generating element for causing ejection of ink, a driver, and a logic circuit were formed. On this substrate, an Al film as the stop layer 3 was formed.

Next, on the surface of the substrate 1, the flow path mold member 3 as a mold of the ink flow path was formed by a mold injection method.

Next, on the rear surface of the substrate 1, a photosensitive resin as the etch resistant film 8 was formed by spin coating. As the photosensitive resin, AZ-P4620 (trade name, manufactured by AZ Electronic Materials Ltd.) was used.

Next, exposure processing was performed to the photosensitive resin with the use of an exposure machine manufactured by EV group Inc., at an exposure amount of 1,000 mJ/cm$^2$ through the photomask A having the pattern for the ink supply ports.

Next, development was performed using an AZ-400K remover, and the etch resistant mask 8*a* was formed, in which the opening pattern for the ink supply ports was formed.

Next, the etch resistant mask 8*a* was heated in an oven at 100° C. for an hour.

Next, from above the etch resistant mask 8*a*, dry etching processing was performed to the substrate 1 using AMS 200 (trade name, manufactured by Alcatel Ltd.) with the Bosch process up to the stop layer 3 formed of the Al film. In this manner, the ink supply ports 10 were formed.

Figure 7:
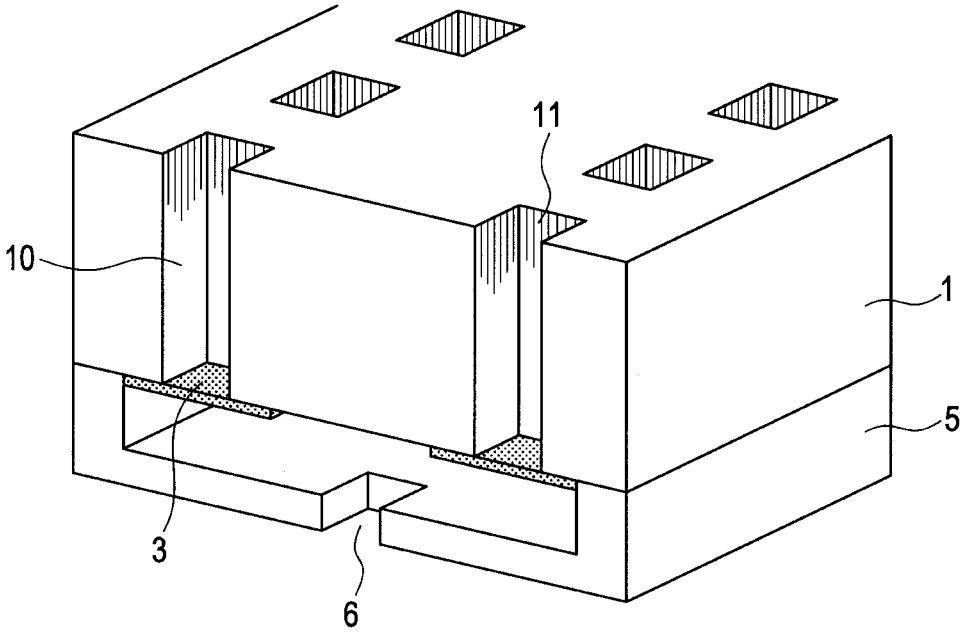
FIG. 7 is a schematic perspective view illustrating the liquid supply port having the groove shape.

In the ink jet recording head manufactured by the above-mentioned method, multiple groove shapes were formed in the side walls of the ink supply ports from the opening surface in the depth direction (direction perpendicular to the surface direction) (see FIG. 7). Further, at least one of the groove shapes had a length of 30 μm or more.

By removing the stop layer formed of the Al film with the use of the removal liquid supplied from the ink supply port, the stop layer was able to be removed in a short time period with good yield.

EXAMPLE 2

In this example, when the exposure processing is performed in order to form the opening pattern for the ink supply port in the etch resistant film, exposure was performed under a state in which the mask was raised from the focus position by 30 μm. Further, the heating processing after the opening pattern formation was not performed. Except for the above-mentioned points, the same steps as those in Example 1 were used to manufacture the ink jet recording head.

In the wall surface of the ink supply port formed in this example, multiple groove shapes were formed from the opening surface in the direction perpendicular to the surface direction. Long grooves among the groove shapes had a length of 30 μm or more.

By removing the stop layer formed of the Al film with the use of the removal liquid supplied from the ink supply port, the stop layer was able to be removed in a short time period with good yield.

COMPARATIVE EXAMPLE 1

The ink jet recording head was manufactured in the same steps as those in Example 1 except for the following point. That is, the fine pattern for the ink supply ports was formed in the etch resistant film without heating the etch resistant mask in an oven at 100° C. for an hour after the fine pattern for the ink supply ports was formed in the etch resistant film.

This ink supply port was formed into such a shape that the scallop pattern was repeated from the start portion to the terminal portion of the opening.

The stop layer formed of the Al film was tried to be removed with the use of the removal liquid supplied from the ink supply port, but in some of the ink supply ports, the removal liquid did not reach to the terminal portion of the opening, and hence the removal of the stop layer was insufficient.

In the liquid ejection head according to the present invention, the liquid supply port includes the groove shape in the wall surface thereof, and hence the removal liquid for the stop layer and the like can be caused to flow into the liquid supply port sufficiently, and the stop layer can be effectively removed in good yield during the manufacturing of the liquid ejection head. Further, the liquid supply port is formed to include the groove shape, and hence it is possible to stably supply liquid such as ink to the liquid supply port, which makes it possible to obtain a liquid ejection head with high reliability, which is capable of suppressing generation of remaining bubbles and the like.

Further, according to the manufacturing method of a liquid ejection head of the present invention, the liquid supply port including the groove shape can be easily formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-211139, filed Sep. 21, 2010, which is hereby incorporated by reference herein in its entirety.

What is claimed is:

1. A liquid ejection head, comprising a substrate comprising:

a liquid supply port for supplying liquid to a liquid flow path which is provided in communication with an ejection orifice for ejecting the liquid; and an energy generating element for generating energy used for ejecting the liquid from the ejection orifice, the energy generating element being disposed at a front surface of the substrate, wherein in a wall surface of the substrate forming the liquid supply port, a plurality of groove shapes are formed extending in a direction substantially perpendicular to a rear surface of the substrate, which is opposite to the front surface of the substrate.

2. A liquid ejection head according to claim 1, wherein the liquid supply port is formed by dry etching processing.

3. A liquid ejection head according to claim 2, wherein the dry etching processing comprises a Bosch process.

4. A liquid ejection head according to claim 1, wherein the plurality of groove shapes are formed up to a middle of the substrate.

5. A liquid ejection head according to claim 1, wherein the plurality of groove shapes are formed to have a length of 30 μm or more from the rear surface of the substrate.

6. A liquid ejection head according to claim 1, wherein a plurality of groove shapes extending in a direction substantially parallel to the rear surface are formed in the wall surface.

7. A liquid ejection head according to claim 6, wherein the plurality of groove shapes extending in the direction substantially perpendicular to the rear surface of the substrate are formed at a location closer to the rear surface than the plurality of groove shapes extending in the direction substantially parallel to the rear surface.

8. A liquid ejection head according to claim 6, wherein the plurality of groove shapes extending in the direction substantially perpendicular to the rear surface of the substrate each have a smaller width than a width of each of the plurality of groove shapes extending in the direction substantially parallel to the rear surface.

9. A liquid ejection head according to claim 6, wherein in a cross-section parallel to the rear surface, a cross-sectional area of the liquid supply port in a region including the plurality of groove shapes extending in the direction substantially perpendicular to the rear surface of the substrate is larger than a cross-sectional area of the liquid supply port in a region including the plurality of groove shapes extending in the direction substantially parallel to the rear surface.

* * * * *